US010883500B2

(12) United States Patent
Lee et al.

(10) Patent No.: US 10,883,500 B2
(45) Date of Patent: Jan. 5, 2021

(54) CO-ROTATING SCROLL COMPRESSOR HAVING DISPLACEMENT BEARING

(71) Applicant: LG ELECTRONICS INC., Seoul (KR)

(72) Inventors: Jaesang Lee, Seoul (KR); Nayoung Jeon, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 579 days.

(21) Appl. No.: 15/706,911

(22) Filed: Sep. 18, 2017

(65) Prior Publication Data

US 2018/0080445 A1 Mar. 22, 2018

(30) Foreign Application Priority Data

Sep. 21, 2016 (KR) ..... 10-2016-0120556

(51) Int. Cl.
*F04C 18/02* (2006.01)

(52) U.S. Cl.
CPC ..... *F04C 18/023* (2013.01); *F04C 2240/30* (2013.01); *F04C 2240/50* (2013.01)

(58) Field of Classification Search
CPC ..... F04C 18/023; F04C 2240/30; F04C 2240/50; F04C 28/22; F04C 2/04; F04C 29/0057; F04C 15/0065; F04C 15/0007; F04C 29/0071
USPC ..... 418/14, 55.5, 57
See application file for complete search history.

(56) References Cited

U.S. PATENT DOCUMENTS 4,610,610 A * 9/1986 Blain ..... F04C 28/22 418/14
4,730,998 A * 3/1988 Kakuda ..... F01C 21/02 384/312
4,846,639 A * 7/1989 Morishita ..... F04C 18/023 418/55.5

(Continued)

FOREIGN PATENT DOCUMENTS

JP 07-332260 12/1995
JP 08-028459 1/1996
JP 08-035492 2/1996

(Continued)

OTHER PUBLICATIONS

International Search Report dated Jan. 17, 2018.

*Primary Examiner* — Patrick Hamo
*Assistant Examiner* — Paul W Thiede
(74) *Attorney, Agent, or Firm* — Ked & Associates, LLP

(57) ABSTRACT

A co-rotating scroll compressor is provided in which a bearing configured to support a scroll is displaced by a torque repulsive force, which is applied to the bearing due to compression repulsion of a compressed fluid, the torque repulsive force is converted into a sealing force of compression chambers, which are defined by wraps of co-rotating scrolls such that the sealing force of the compression chambers is increased, and in which a bearing housing is rotatably installed in a housing accommodation hole, a rotational center of a second scroll is positioned at a position eccentric from a rotational center of a bearing housing, the bearing housing is rotated by the torque repulsive force applied to the second scroll, some of the torque repulsive force is converted into the sealing force against a sealing disturbing force.

20 Claims, 13 Drawing Sheets

(56) References Cited

U.S. PATENT DOCUMENTS 5,224,849 A * 7/1993 Forni ..... F04C 29/0057
418/55.5
5,803,722 A * 9/1998 Noboru ..... F04C 18/023
418/55.5

FOREIGN PATENT DOCUMENTS

| | | |
|---|---|---|
| JP | 2012-215092 | 11/2012 |
| KR | 10-2016-0026121 | 3/2016 |

* cited by examiner

CO-ROTATING SCROLL COMPRESSOR HAVING DISPLACEMENT BEARING

CROSS-REFERENCE TO RELATED APPLICATION(S)

This application claims priority to and the benefit of Korean Patent Application No. 10-2016-0120556, filed in Korea on Sep. 21, 2016, the disclosure of which is incorporated herein by reference in its entirety.

BACKGROUND

1. Field

A co-rotating scroll compressor having a displacement bearing is disclosed herein.

2. Background

A scroll compressor is a compressor in which a fluid introduced therein is compressed toward a center of two scrolls which orbit relative to each other due to shapes of wraps of the two scrolls and discharged from the center of the scrolls in a compressed state. Each of the scrolls has a structure in which the wrap is formed in an end plate, and the scroll compressor is formed such that portions at which the wraps of the two scrolls are formed face each other, the wraps overlap, and side surfaces of the wraps are in contact with each other so as to provide a compression space.

The scroll compressor uses a pair of scrolls according to a principle of compression. One conventional compressor is an orbiting scroll compressor, in which one scroll is fixed and the other scroll does not rotate but rather, orbits to compress a fluid. The orbiting scroll compressor has to operate such that the orbiting scroll orbits but does not rotate about the fixed scroll, and as a center of gravity of the orbiting scroll has to be eccentric from a center of orbiting in principle, there is a problem in that vibration increases due to a centrifugal force proportional to a square of a speed as a rotational speed increases. However, in a co-rotating scroll compressor, as a drive scroll and a driven scroll rotate in a same direction and rotary shafts only rotate about deviated rotational centers and do not orbit, there are no centrifugal problems due to the eccentric centers which may occur in the orbiting scroll compressor in principle.

When the wraps of the two scrolls face and orbit relative to each other to compress a fluid and when surfaces of the wraps of the two scrolls which face each other and form compression pockets are not pressed against each other, a pressure of the compressed fluid leaks, and thus, there is a problem in that compression efficiency decreases.

In the orbiting scroll compressor, only the orbiting scroll orbits, in a state in which the fixed scroll does not rotate and is fixed to a frame of the compressor. As the orbiting scroll is influenced by a centrifugal force while orbiting, when the orbiting scroll compressor is designed such that the centrifugal force applied to the orbiting scroll is applied in a direction in which the compression pockets formed by the wraps of the two scrolls are sealed, the compression pockets can be sealed.

However, in the co-rotating scroll compressor, as both the drive scroll and the driven scroll rotate about the rotary centers thereof, a centrifugal force like in the orbiting scroll of the orbiting scroll compressor is not generated. However, from a view point of a frame, which is a fixed coordinate system, as the co-rotating scroll compressor has a structure in which a pair of compression pockets positioned to face each other around the center of the scrolls linearly move from a suction room to a discharge room, a torque repulsive force and a sealing disturbing force are continuously applied to a bearing configured to support the rotary shafts of the scrolls in one direction.

Accordingly, in the co-rotating scroll compressor, as bearings installed at the frame are formed such that each of the bearings may move and some of the torque repulsive force is converted into a sealing force against the sealing disturbing force according to a movement direction of the bearing, the wraps of the two scrolls are pressed against each other, and thus, the compression pockets are completely sealed. However, as a machining process of forming such a compressor is complex, a cost of the compressor may increase. In addition, as the driven scroll is installed at a displacement bearing, there is a problem in that an assembly process of the compressor may also be very complex.

BRIEF DESCRIPTION OF THE DRAWINGS

Embodiments will be described in detail with reference to the following drawings in which like reference numerals refer to like elements, and wherein.

DETAILED DESCRIPTION

Figure 1:
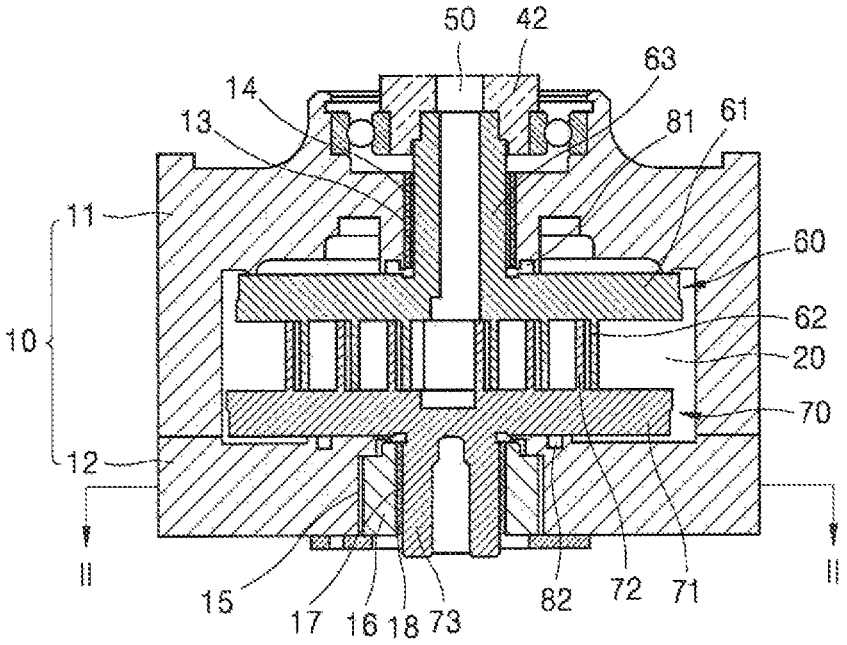
FIG. 1 is a schematic cross-sectional view illustrating a frame of a co-rotating scroll compressor according to an embodiment.

Hereinafter, embodiments will be described with reference to the accompanying drawings. Where possible, like reference numerals have been used to indicate like elements, and repetitive disclosure has been omitted. Embodiments are not limited to the embodiments described below and may be made in various different forms, the embodiments are provided for complete disclosure, and a scope is known to those skilled in the art.

FIG. 1 is a schematic cross-sectional view illustrating a frame of a co-rotating scroll compressor according to an embodiment. The co-rotating scroll compressor according to this embodiment may include a frame 10 which may form an overall exterior thereof, be configured to accommodate drive sources 42 and 50 and co-rotating scrolls 60 and 70 thereinside, and divide a space of a compression chamber 20 in which a fluid compressed and another space in a casing (not shown) of the compressor. The frame 10 may be assembled through a method in which a main frame 11 and a sub-frame 12 are separately manufactured and directly or indirectly fixed to each other for the sake of convenience in manufacture and assembly. A number and positions of components may be variously changed and modified within a range necessary for the sake of convenience in manufacture and assembly.

The compression chamber 20 may be formed in a predetermined region of the frame 10, and a suction port (not shown), which is a path through which a fluid may be introduced, may be formed in a side surface of the compression chamber 20. The compression chamber 20 may include first scroll 60 and second scroll 70 each configured to rotate about a rotational shaft thereof. The first scroll 60 may be located above the second scroll 70 and may serve as a drive scroll configured to receive a rotational force from a drive source to rotate, and the second scroll 70 may be located below the first scroll 60 and may serve as a driven scroll configured to receive the rotational force from the first scroll 60 to rotate relative to the first scroll 60.

The first scroll 60 may include an end plate 61 in a substantially circular plate shape, and a wrap 62 in a spiral or involute shape that protrude from a first (lower) surface of the end plate 61, that is, from a surface facing the second scroll 70, toward the second scroll 70. A boss 63, which is a rotational center of the first scroll 60, may protrude from a center of a second (an upper) surface of end plate 61, that is, from a surface opposite the surface facing the second scroll 70. The boss 63 may be formed in a substantially cylindrical shape, be accommodated in a bearing installation hole 13 formed in the frame 10 and located above the compression chamber 20, and be rotatably supported by a fixed bearing 14.

The second scroll 70 also may include an end plate 71 in a substantially circular plate shape, and a wrap 72 in a spiral shape that protrude from a first (an upper) surface of the end plate 71, that is, from a surface facing the first scroll 60, toward the first scroll 60. A boss 73, which is a rotational center of the second scroll 70, may protrude from a center of a second (lower) surface of the end plate 71, that is, from a surface opposite the surface facing the first scroll 60. The boss 73 may be formed in a substantially cylindrical shape and be rotatably supported by a moving bearing 18 installed in a bearing housing 16 accommodated to be linearly or rotatably moveable in a housing accommodation hole 15 formed in the frame 10 and located under the compression chamber 20.

That is, the housing accommodation hole 15 may be formed in the sub-frame 12, and the bearing housing 16 may be moveably accommodated in the housing accommodation hole 15. The bearing housing 16 may rotate, linearly move, or swing, for example, in the housing accommodation hole 15 to be displaced as necessary for securing a sealing force of wraps, which will be described hereinafter.

A bearing accommodation hole 17 that fixing the moving bearing 18 may be formed n the bearing housing 16, and the moving bearing 18 may be coupled to the bearing accommodation hole 17 through an interference fitting method, for example. In addition, the boss 73 of the second scroll 70 may be inserted into the moving bearing 18 and rotatably supported thereby.

A central rotational shaft of the first scroll 60 may be aligned with a geometrical axis of the boss 63, and a central rotational shaft of the second scroll 70 may be aligned with a geometrical axis of the boss 73. That is, the first scroll 60 and the second scroll 70 may respectively rotate about the end plates 61 and 71 without eccentricity, and such rotary movements may be supported by the bosses 63 and 73 and the bearings 14 and 18. However, as locations of axes of the boss 63, the bearing installation hole 13, and the fixed bearing 14 are deviated from locations of axes of the boss 73, the housing accommodation hole 15, and the moving bearing and directions of the axes thereof are parallel, when the two scrolls rotate in the same direction, the wraps of the two scrolls orbit relative to each other.

As described above, in the co-rotating scroll compressor, although the rotary shafts of the two scrolls are positioned to be deviated from each other, the rotary shafts of the scrolls are located at geometrical centers of shapes of the corresponding scroll end plates from a viewpoint of each of the scrolls. Accordingly, as each of the scrolls does not have eccentricity relative to the rotary shaft, a centrifugal force or vibrations large enough to cause a problem during operation of compressor are not generated even when the scrolls rotate at a high speed.

In this embodiment, the bosses 83 and 73 are rotatably supported by the bearing, but other structures, for example, a bushing, may also be applied thereto. That is, a mechanical component configured to reduce friction loss may be applied between a rotary shaft (boss) of a corresponding scroll and the bearing installation hole 13 of the frame 10 or the bearing accommodation hole 17 of the bearing housing 16.

The drive sources may be located above the compression chamber 20. As illustrated in the drawing, a rotor 42 may be installed at an outer circumferential portion of a drive rotary shaft 50, and the rotor 42 may be surrounded by an annular stator (not shown) which has a same center as the rotor 42 and is spaced apart from the rotor 42. In addition, a lower portion of the drive rotary shaft 50 may be mutually coupled to a front end portion or end of the boss 63 of the first scroll 60 such that a rotational force may be transmitted therebetween. That is, the drive rotary shaft 50 and the boss 63 of the drive scroll may be coupled to be mutually restricted in a rotational direction but not to mutually restrict in a direction of the shaft.

A rotary force transmitting portion and a rotary force transmitted portion have a structure in which a rotational force whose rotational center is a central shaft of the drive rotary shaft 50 is transmitted thereby, but an upsetting moment applied to the first scroll 60 due to a compression repulsive force of a fluid is not transmitted thereby. Accordingly, the drive rotary shaft 50 may be smoothly rotated by a stator and the rotor 42 without being influenced by the upsetting moment applied to the first scroll 60.

A rotational force of the first scroll 60 is transmitted to the second scroll 70 by an Oldham ring or another rotation prevention power transmission structure. That is, the rotation prevention power transmission structure is a mechanical structure configured to allow the first scroll and the second scroll to rotate in a same direction at a same speed such that rotation of the second scroll relative to the first scroll is prevented and to transmit the rotational force of the first scroll to the second scroll.

According to a theoretical working principle of the co-rotating scroll compressor, when the wraps 62 and 72 of the first scroll 60 and the second scroll 70 rotate while facing and being in contact with each other, the rotational force of the first scroll 60 is transmitted to the second scroll 70 through the wraps. However, as the rotational force tends not to be easily transmitted due to a compression repulsive force, for example, generated by a fluid in the compression chamber formed by the two wraps, the above described Oldham ring or other rotation prevention power transmission structure may be applied to the co-rotating scroll compressor.

As described above, the central axes of the two bosses 63 and 73 are parallel to but slightly deviated from each other. Accordingly, when the drive rotary shaft 50 transmits the rotational force to the first scroll 60 while rotating, the first scroll 60 transmits the rotational force to the second scroll 70 through the Oldham ring or the other rotation prevention power transmission structure.

The first scroll 60 and the second scroll 70 rotate in the same direction, and portions at which the wraps 62 and 72 of the first scroll 60 and the second scroll 70 are in contact with each other decrease areas of compression pockets configured to confine and compress a fluid and move toward the center of the scrolls according to the rotation of the two scrolls. In addition, the compressed fluid is discharged outside of the compression chamber 20 through discharge ports formed at a center of the end plate 61 of the first scroll 60 and the boss 63. That is, a fluid introduced through the suction port is confined by the compression pockets formed by the wraps of the two scrolls 60 and 70, is compressed while moving toward the center of the two scrolls, and is discharged through the discharge ports. In addition, the compressed fluid discharged to the outside of the frame 10 through the discharge ports is discharged to an outside of the compressor through a discharge hole that communicates with the outside of the compressor.

An inner space of the casing of the compressor becomes a space in which a pressure of a compression fluid is generated. In consideration of such a viewpoint, pressure rings 81 and 82 configured to prevent movement of the fluid due to a pressure difference between the compression chamber 20 and outside of the compression chamber 20 and to maintain a pressure difference therebetween may be formed between the end plate 61 of the first scroll 60 and an inner wall surface of the compression chamber 20 facing the end plate 61 and between the end plate 71 of the second scroll 70 and an inner wall surface of the compression chamber 20 facing the end plate 71.

Figure 2:
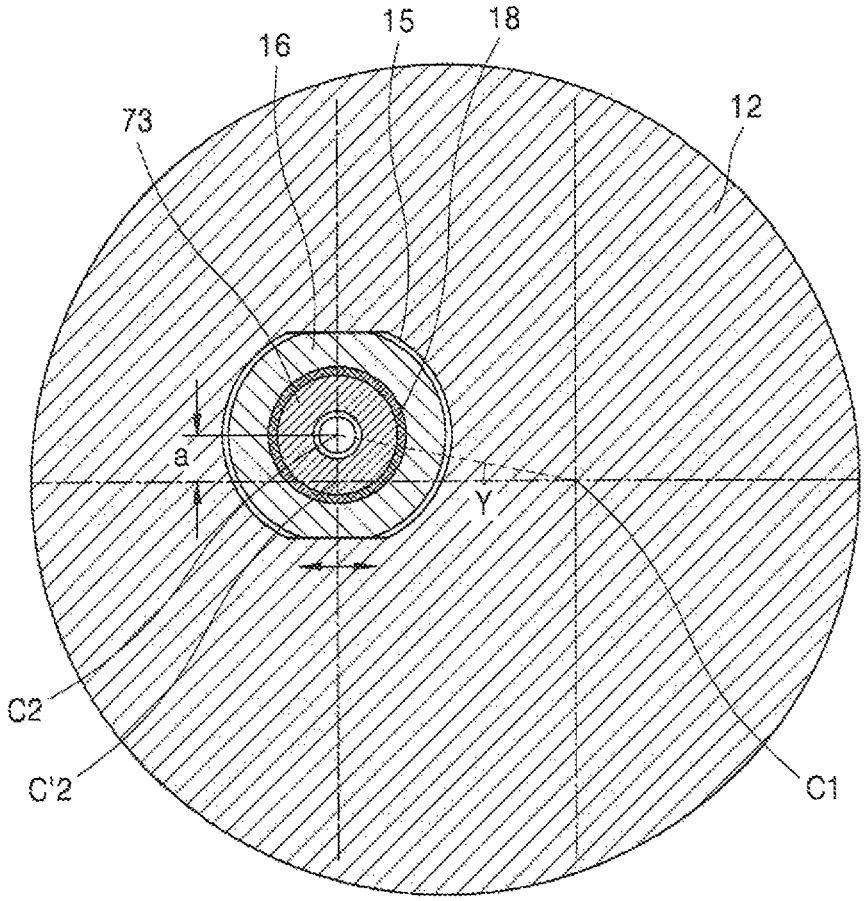
FIG. 2 is a cross-sectional view, taken along line II-II of FIG. 1, illustrating a rotary shaft support of a second scroll of FIG. 1 according to an embodiment.
Figure 3:
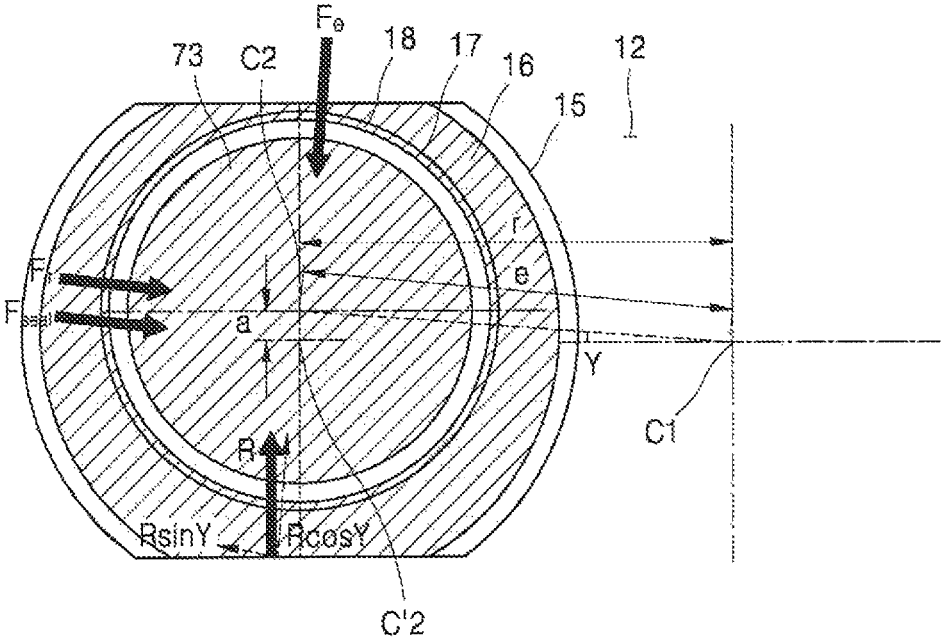
FIG. 3 is a view illustrating a rotary shaft support of the second scroll of FIG. 1 according to another embodiment.

FIG. 2 is a cross-sectional view, taken along line II-II of FIG. 1, illustrating a rotary shaft support of a second scroll of FIG. 1 according to an embodiment. FIG. 3 is a view illustrating a rotary shaft support of the second scroll of FIG. 1 according to another embodiment. In the co-rotating scrolls, as each of the scrolls rotates about the corresponding rotary shaft but does not eccentrically rotate when rotating, a centrifugal force is hardly generated. Accordingly, the wrap of at least one scroll of the two scrolls has to be pressed against the wrap of the other scroll to prevent leakage from compression pockets formed by the two wraps and maintain a contact force between the wraps 62 and 72 of the first scroll and the second scroll.

First, referring to FIG. 2, the housing accommodation hole 15 is formed in the sub-frame 12. The housing accommodation hole 15 is a hole in a track shape having a long axis and a short axis, and the bearing housing 16 accommodated in the hole may move in a longitudinal direction of the long axis. The bearing housing 16 is also formed in a track shape having a long axis and a short axis, the long axis of the bearing housing 16 is shorter than the long axis of the housing accommodation hole 15, and a width of the short axis of the bearing housing 16 is the same as a width of the short axis of the housing accommodation hole 15. Accordingly, the bearing housing 16 inserted into the housing accommodation hole 15 may move in a direction of the long axis thereof.

A theoretical rotational center C'2 of the second scroll 70 exists in the sub-frame 12 with respect to a rotational center C1 of the first scroll 60 installed on the main frame 11. In addition, the long axis of the housing accommodation hole 15 extends parallel to a straight line from the rotational center C1 of the first scroll 60 to the theoretical rotational center C'2 of the second scroll 70.

According to the embodiment illustrated in FIG. 2, the housing accommodation hole 15 is offset a predetermined distance a from the straight line from the rotational center C1 of the first scroll 60 to the theoretical rotational center C'2 of the second scroll 70. A direction of the offset is opposite an acting direction of a torque repulsive force Fθ applied to the boss 73 of the second scroll 70 by the compression pockets compressed while the first scroll 60 and the second scroll 70 rotate.

Although it will be described below, an angle Y formed between the straight line from the rotational center C1 of the first scroll 60 to the theoretical rotational center C'2 of the second scroll 70 and a straight line from the rotational center C1 of the first scroll 60 to a real rotational center C2 of the second scroll 70 after the housing accommodation hole 15 is offset as described above relates to a ratio of the torque repulsive force applied to the boss 73 to a sealing force converted from the torque repulsive force.

FIG. 2 is a view illustrating a structure in which the housing accommodation hole 15 is offset and the moving bearing 18 is not offset from the bearing housing 16 accommodated in the housing accommodation hole 15. However, in addition to the above structure, various structures in which the moving bearing 18 is offset from the straight line from the rotational center C1 of the first scroll 60 to the theoretical rotational center C'2 of the second scroll 70 may exist.

For example, FIG. 3 is a view illustrating an embodiment in which the housing accommodation hole 15 and the bearing housing 16 are not offset from the straight line from the rotational center C1 of the first scroll 60 to the theoretical rotational center C'2 of the second scroll 70, the moving bearing 18 is offset from the bearing housing 16 accommodated in the housing accommodation hole 15, and thus, the moving bearing 18 is ultimately offset from the straight line from the rotational center C1 of the first scroll 60 to the theoretical rotational center C'2 of the second scrod 70. Referring to FIG. 3, as the housing accommodation hole 15 is not offset from the rotational center C1 of the first scroll 60 and the theoretical rotational center C'2 of the second scroll 70, when the housing accommodation hole 15 is formed, a jig for angular machining is not required and eccentric machining is also not required to form a hole in the sub-frame, and thus, a machining difficulty and a manufacturing cost may be lowered. That is, machining the bearing accommodation hole 17 in the bearing housing 16 is easier from a viewpoint of manufacture.

Next, the rotary shaft, which is the boss 73 of the second scroll 70, is offset by a distance a from the straight line from the rotational center C1 of the first scroll 60 to the theoretical rotational center C'2 of the second scroll 70. That is, a center of the boss 73 moves in a direction parallel to the straight line from the rotational center C1 of the first scroll 60 to the theoretical rotational center C'2 of the second scroll 70, but a movement trajectory of the center is eccentrically positioned by the distance a with respect to the straight line from the rotational center C1 of the first scroll 60 to the theoretical rotational center C'2 of the second scroll 70.

A sealing disturbing force Fr (applied in a direction of the straight line from the rotational center C1 of the first scroll 60 to the real rotational center C2 of the second scroll 70) and the torque repulsive force Fθ (applied in a direction perpendicular to the straight line from the rotational center C1 of the first scroll 60 to the real rotational center C2 of the second scroll 70) are inclined by the angle Y generated due to the offset distance a and applied to the boss 73 located at the offset position, a repulsive force R is accordingly generated on a surface facing the bearing housing 16, as illustrated in the drawing, and the repulsive force R is divided into components of the torque repulsive force Fθ and the sealing disturbing force Fr, and a component (R sin(Y)) parallel to the sealing disturbing force and resisting the sealing disturbing force.

Accordingly, a sealing force Fseal of the two wraps may be denoted as R sin(Y)−Fr. In addition, the sealing force Fseal is equal to Fθ tan(Y)−Fr, where Y is $\sin^{-1}(a/e)$, a is an offset distance, and e is a distance from the rotational center C1 of the first scroll 60 to the real rotational center C2 of the second scroll 70. As a result, when $F\theta \sin^{-1}(a/e)-Fr>0$, the sealing force is generated between the two wraps. That is, when the rotary shaft of the second scroll 70 is offset within a range of $F\theta \sin^{-1}(a/e)-Fr>0$, the sealing force may be generated between the two wraps 62 and 72, and thus, leakage from the compression pockets may be prevented. Of course, the co-rotating scroll compressor may also be designed such that a value of $F\theta \sin^{-1}(a/e)-Fr$ may be several hundred newtons (N) or more to generate a more definite sealing force.

According to the above described moving bearing installation structure using the offset, machining the moving bearing installation structure is easier than when there is angular displacement. More particularly, as illustrated in FIG. 3, when the moving bearing 18 is offset from the bearing housing 16 without being offset from other components, machining is simpler.

Figure 4:
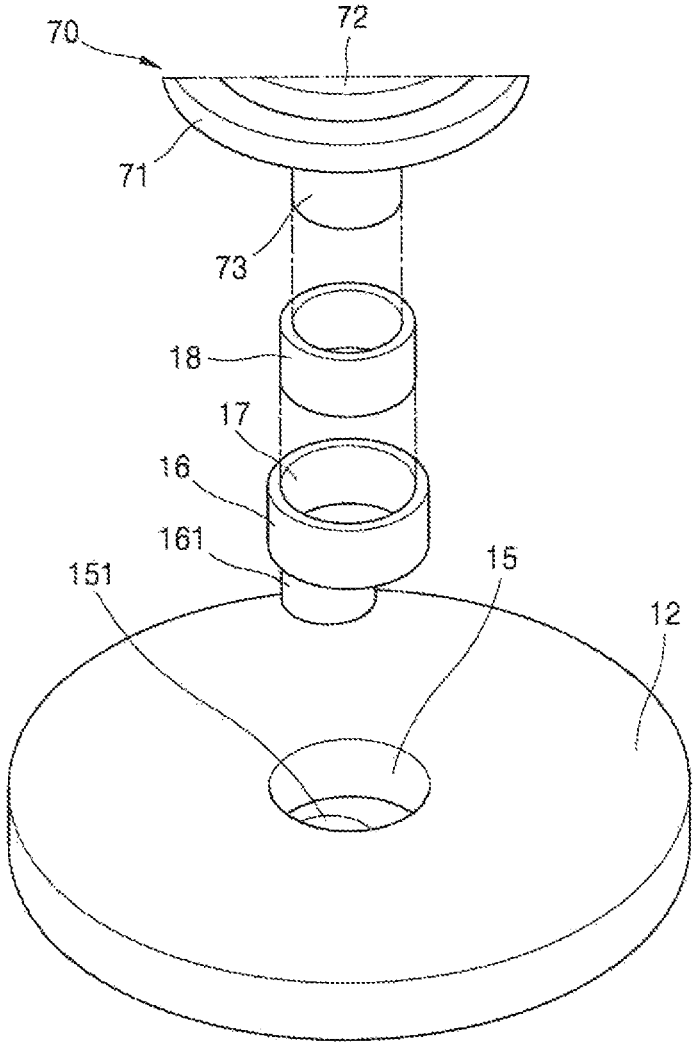
FIG. 4 is an exploded perspective view of rotary shaft support of the second scroll according to another embodiment.
Figure 5:
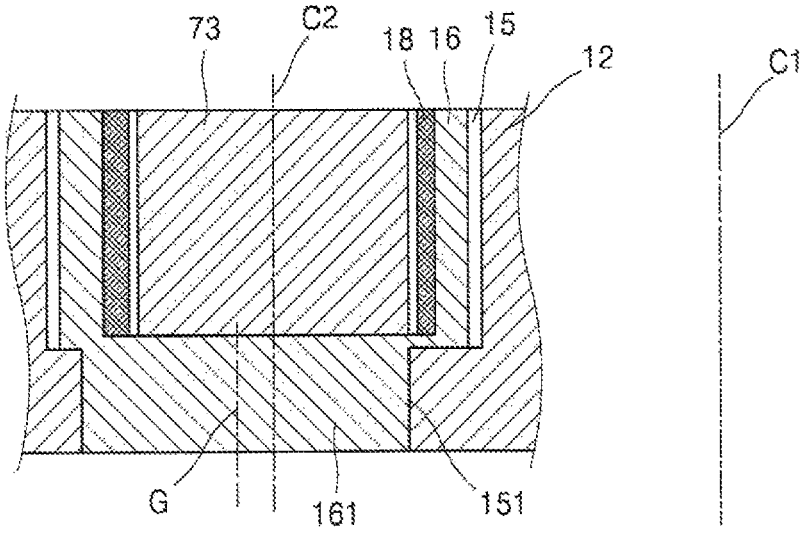
FIG. 5 is a side cross-sectional view illustrating the rotary shaft support of FIG. 4.
Figure 6:
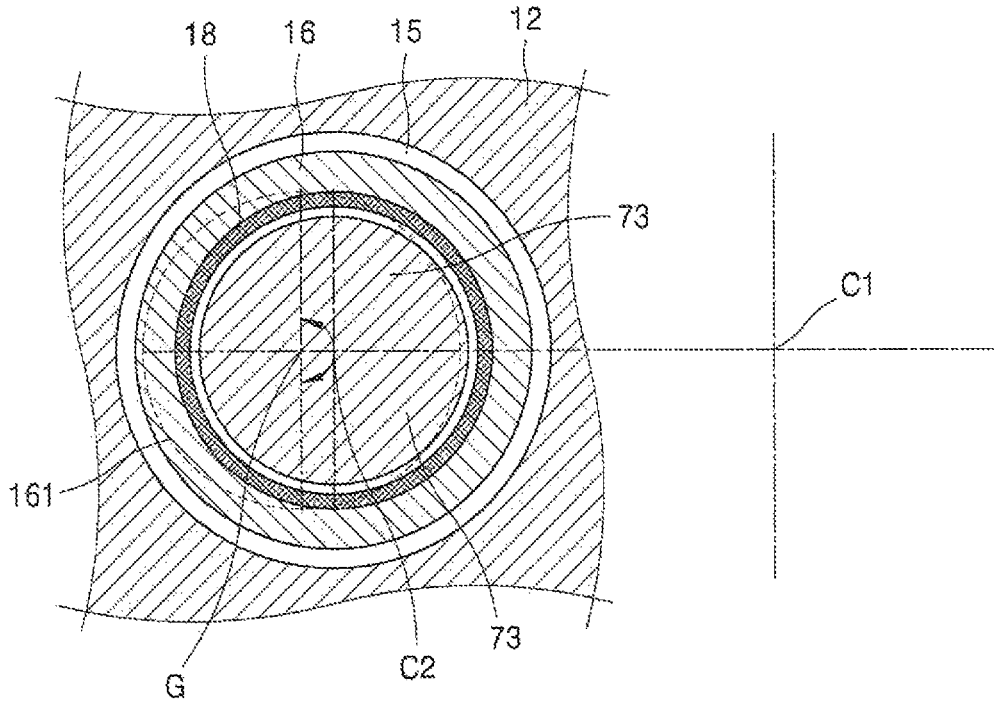
FIG. 6 is a top cross-sectional view illustrating the rotary shaft support of FIG. 4.

FIG. 4 is an exploded perspective view of a rotary shaft support of the second scroll according to another embodiment. FIG. 5 is a side cross-sectional view illustrating the rotary shaft support of FIG. 4. FIG. 6 is a top cross-sectional view illustrating the rotary shaft support of FIG. 4.

Housing accommodation hole 15 which may accommodate bearing housing 16 may be formed in sub-frame 12. As the bearing housing 16 is smaller than the housing accommodation hole 15, the bearing housing 16 may move in the housing accommodation hole 15. A swing shaft 161 may be formed under the bearing housing 16, and the swing shaft 161 may be rotatably inserted into a swing center hole 151 formed in a bottom surface of the housing accommodation hole 15. An outer circumferential surface of the swing shaft 161 and an inner circumferential surface of the swing center hole 151 may be coupled to have a same axis and rotate relative to each other.

Bearing accommodation hole 17 may be formed in the bearing housing 16, a center C2 of the bearing accommodation hole 17 may be eccentrically positioned with respect to a center G of the swing shaft 161. Accordingly, when the bearing housing 16 swings around the swing center G, a rotary shaft of the second scroll 70 installed by inserting moving bearing 18 into the bearing accommodation hole 17 swings in a direction of an arrow illustrated in FIG. 6.

Referring to FIG. 6 when sealing disturbing force Fr and torque repulsive force Fθ are generated at the rotary shaft of the second scroll 70 during compression, the center of the rotary shaft swings in the direction of the arrow due to the torque repulsive force Fθ and sealing force Fseal which resists the sealing disturbing force Fr is generated. Accordingly, the torque repulsive force is converted into the sealing force. However, the torque repulsive force may not be converted into the sealing force but the opposite case may occur according to where the rotational center of the second scroll 70 is located. Accordingly, setting of a range within which the rotational center of the second scroll 70 may be located is required.

Figure 13:
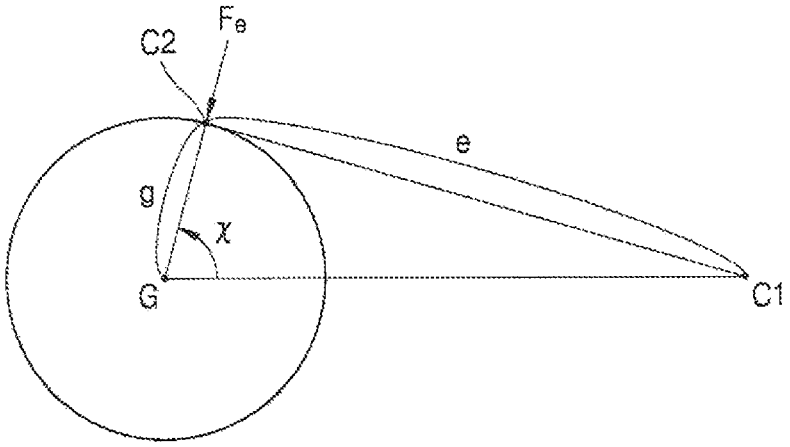
FIG. 13 is a view illustrating a geometric relationship between components in each of the rotary shaft support of FIGS. 4 and 11.

Referring to FIG. 13, under the premise what a distance between rotational center C1 of first scroll 60 and swing center G is greater than or equal to a swing radius g, that is, C1 is located outside of a circle having the swing center G and the swing radius g, when the rotational center C2 of the second scroll 70 is moved by the torque repulsive force Fθ generated when the second scroll 70 rotates, the rotational center C2 of the second scroll 70 has to move away from the rotational center C1 of the first scroll 60. In addition, an application direction of the torque repulsive force Fθ applied to the rotational center C2 of the second scroll 70 is perpendicular to a straight line from the rotational center C2 of the second scroll 70 to the rotational center C1 of the first scroll 60. Under the above conditions, a angular range x within which the rotational center C2 of the second scroll 70 has to be located is as follows.

When an angular displacement x relative to a line from the swing center G to the rotational center C1 of the first scroll is measured on the basis of the swing center G, in the case in which the rotational center C2 of the second scroll 70 is positioned at a position swung by a predetermined angle x in a direction opposite an acting direction of the torque repulsive force Fθ and the predetermined angle x falls within, a range of $\tan^{-1}(e/g)<x<180°$" or "$360°-\tan^{-1}(e/g)<x\leq 360°$, where e is a distance from the rotational center C1 of the first scroll 60 to the rotational center C2 of the second scroll 70, and g is a distance from the swing center G to the rotational center C2 of the second scroll 70, the torque repulsive force may be converted into the sealing force.

As described above, the rotational center C2 of the second scroll 70 has to be positioned to meet the condition of the angular displacement x, and in addition, when the first scroll 60 and the second scroll 70 are assembled, wraps 62 and 72 may be positioned at positions to be easily engaged with each other without interference therebetween. Accordingly, embodiments may further include a swing range restriction structure or restrictor configured to restrict a movement angle of the rotational center C2 of the second scroll 70.

Referring to FIGS. 4 to 6, although the housing accommodation hole 15 is larger than the bearing housing 16 but is not large enough for the bearing housing 16 to rotate within all angular ranges, the bearing housing 16 may swing around the swing center G within a range in which an inner circumferential portion of the housing accommodation hole 15 does not interfere with an outer circumferential portion of the bearing housing 16. Accordingly, as long as the housing accommodation hole 15 accommodates the bearing housing 16 through an assembly process like in FIG. 4, the bearing housing 16 is installed within the predetermined angular range x, the second 70 scroll and the first scroll 60 may be easily assembled, and thus, the torque repulsive force generated at the second scroll 70 when the compressor operates may be converted into the sealing force Fseal.

Such a swing range restriction structure or restrictor may be variously modified.

Figure 7:
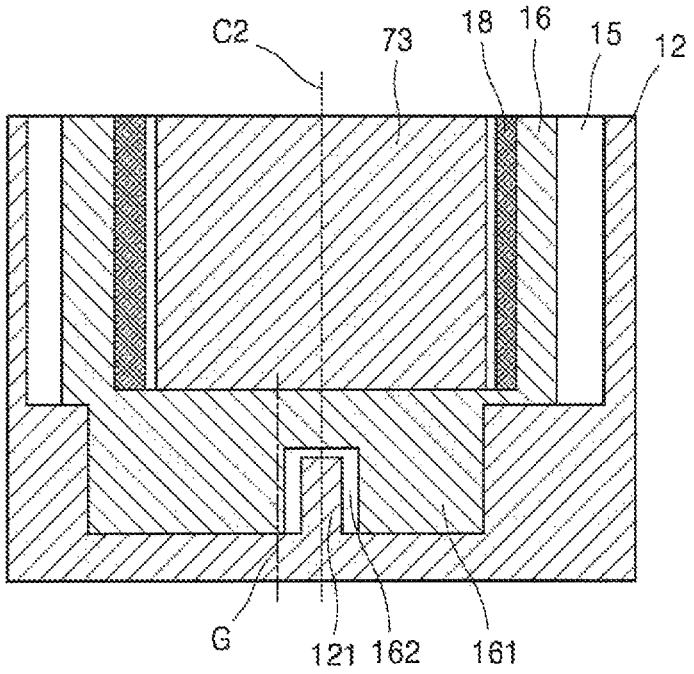
FIG. 7 is a side cross-sectional view illustrating a first modified example of the rotary shaft support of FIG. 4.
Figure 8:
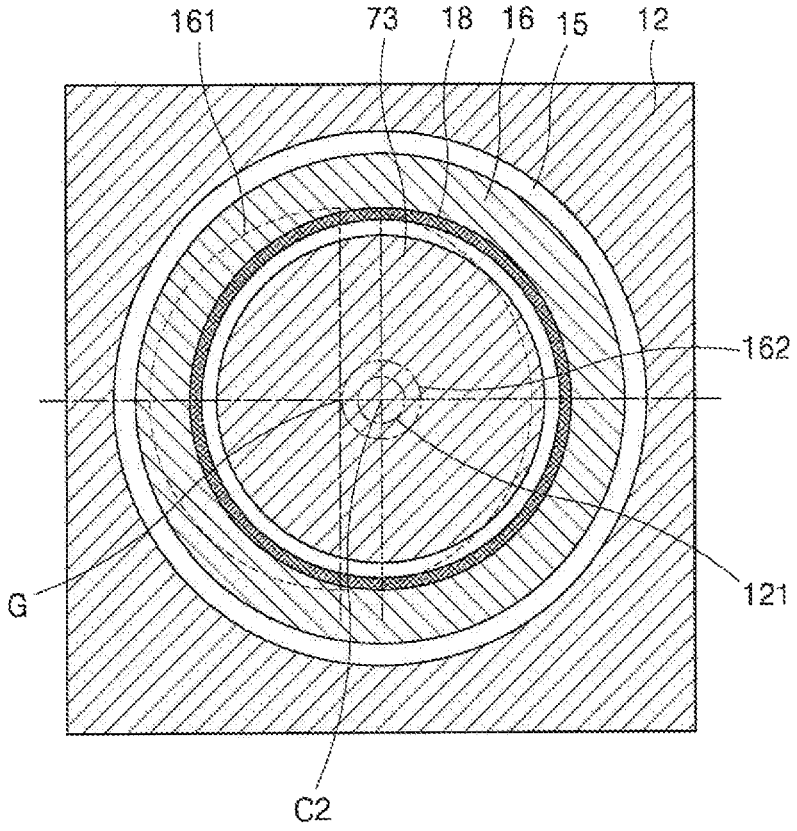
FIG. 8 is a top cross-sectional view illustrating the first modified example of the rotary shaft support of FIG. 4.

FIG. 7 is a side cross-sectional view illustrating a first modified example of the rotary shaft support of FIG. 4. FIG. 8 is a top cross-sectional view illustrating the first modified example of the rotary shaft support of FIG. 4. As illustrated in FIGS. 7 and 8, a swing restrictor protrusion 121 may be formed on the sub-frame 12, a swing restrictor groove 162 may be formed in the swing shaft 161, and when an area of the swing restrictor groove 162 is greater than an area of the swing restrictor protrusion 121 and the swing restrictor groove 162 accommodates the swing restrictor protrusion 121, a position of the rotary shaft of the second scroll 70 and a swing range thereof may be restricted, and thus, the second scroll 70 and the first scroll 60 may be easily assembled and the torque repulsive force generated at the second scroll 70 when the compressor operates may be converted into the sealing force Fseal.

Figure 9:
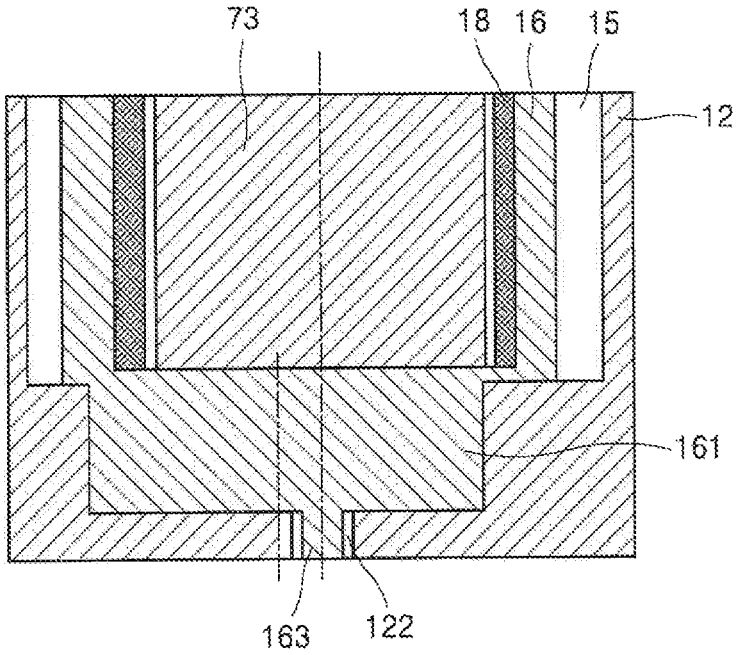
FIG. 9 is a side cross-sectional view illustrating a second modified example of the rotary shaft support of FIG. 4.
Figure 10:
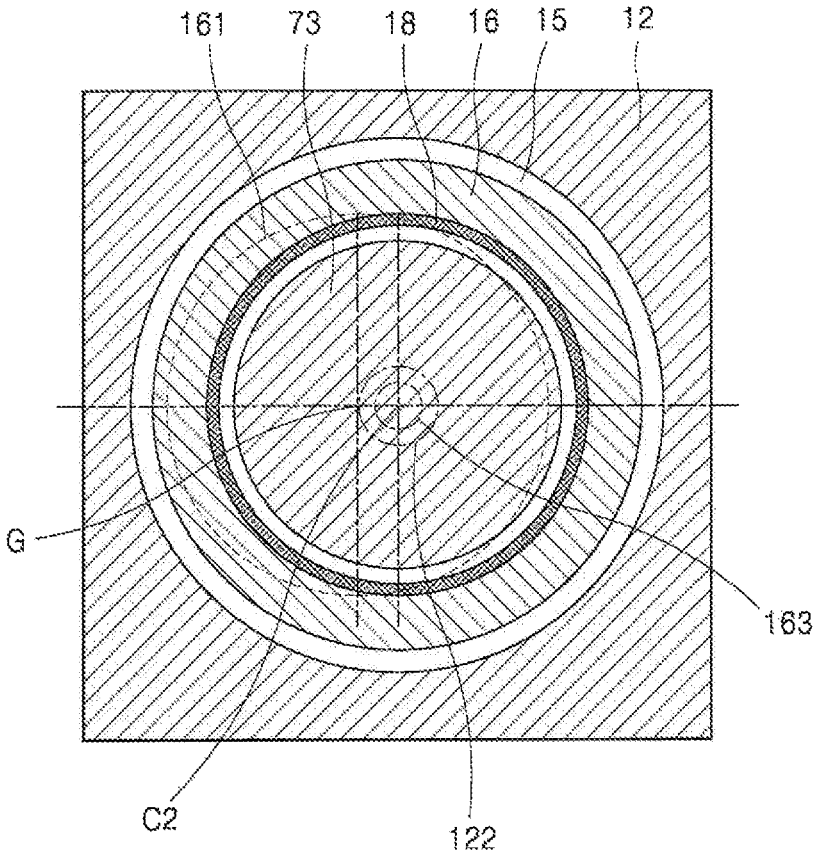
FIG. 10 is a top cross-sectional view illustrating the second modified example of the rotary shaft support of FIG. 4.

FIG. 9 is a side cross-sectional view illustrating a second modified example of the rotary shaft support of FIG. 4. FIG. 10 is a top cross-sectional view illustrating the second modified example of the rotary shaft support of FIG. 4. As illustrated in FIGS. 9 and 10, a swing restrictor protrusion 163 may be formed on the swing shaft 161, a swing restrictor groove 122 may be formed in the frame 12, and when an area of the swing restrictor groove 122 is greater than an area of the swing restrictor protrusion 163 and the swing restrictor groove 122 accommodates the swing restrictor protrusion 163 such that the swing restrictor protrusion 163 may swing, a position of the rotary shaft of the second scroll 70 and a swing range thereof may be restricted, and thus, the second scroll 70 and the first scroll 60 may be easily assembled and the torque repulsive force generated at the second scroll 70 when the compressor operates may be converted into the sealing force Fseal.

In another embodiment of the moving bearing installation structure, there is a difference from the previous embodiments in that bearing housing 16 may not include an additional swing shaft 161, and the bearing housing 16 itself may serve as the swing shaft of the previous embodiment, but other structures are the same as or similar to the previous embodiments.

Figure 11:
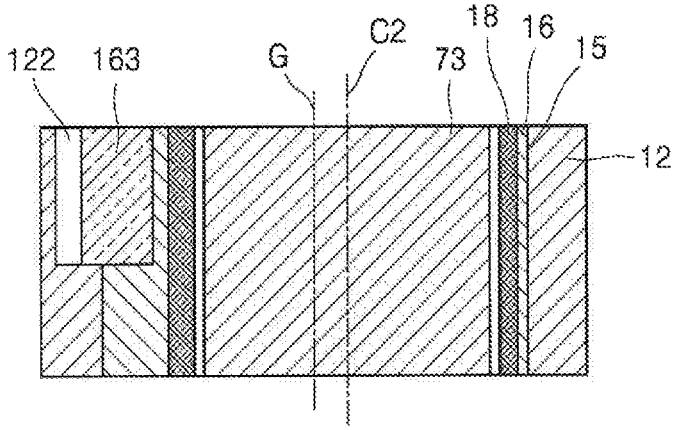
FIG. 11 is a side cross-sectional view of a rotary shaft support of the second scroll of FIG. 2 according to another embodiment.
Figure 12:
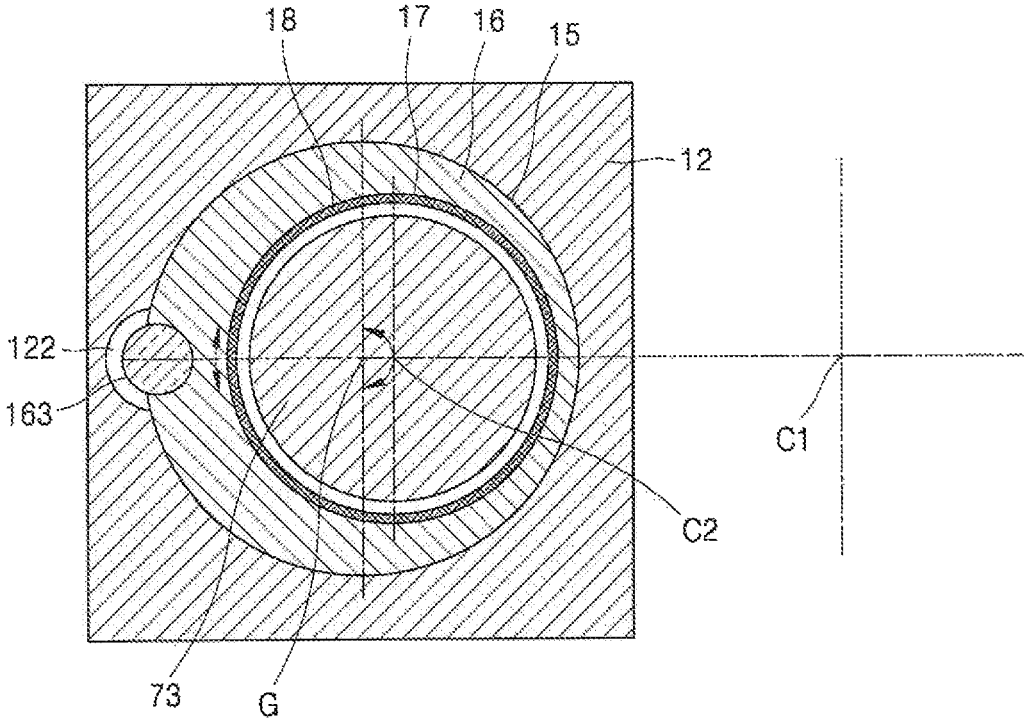
FIG. 12 is a top cross-sectional view of the rotary shaft support of FIG. 11.

FIG. 11 is a side cross-sectional view of a rotary shaft support of the second scroll of FIG. 2 according to another embodiment. FIG. 12 is a top cross-sectional view of the rotary shaft support of FIG. 11.

Housing accommodation hole 15 in a circular shape which may accommodate bearing housing 16 may be formed in sub-frame 12. The bearing housing 16 may have a circular cross-section having a size and shape corresponding to the housing accommodation hole 15, and may rotatably move within the housing accommodation hole 15. That is, rotational center G of the bearing housing 16 may be a center of a circle.

Bearing accommodation hole 17 may be formed in the bearing housing and center C2 of the bearing accommodation hole 17 may be eccentrically positioned with respect to the rotational center G of the bearing housing 16. Accordingly, when the bearing housing 16 rotates about the rotational center G, a rotary shaft of the second scroll 70 installed by inserting moving bearing 18 into the bearing accommodation hole 17 rotates as illustrated with the arrow in FIG. 12.

When sealing disturbing force Fr and torque repulsive force Fθ are generated at the rotary shaft of the second scroll 70 during compression, the center C2 of the rotary shaft rotates about the rotational center G of the bearing housing 16 in the direction of the arrow due to the torque repulsive force Fθ, and thus, sealing force Fseal which resists the sealing disturbing force Fr is generated. Accordingly, the torque repulsive force is converted into the sealing force.

Referring to FIG. 13, similarly to the previous embodiment, when angular displacement x relative to a line from the rotational center G of the rotary shaft of the second scroll 70 to rotational center C1 of the first scroll 60 is measured on the basis of the rotational center G, in the case in which rotational center C2 of the second scroll 60 is positioned at a position rotated by a predetermined angle x in a direction opposite an acting direction of the torque repulsive force Fθ and the predetermined angle x falls within a range of $\tan^{-1}(e/g)<x<180°$ or $360°-\tan^{-1}(e/g)<x\leq 360°$ where e is a distance from the rotational center C1 of the first scroll 60 to the rotational center C2 of the second scroll 70, and g is a distance from the rotational center G to the rotational center C2 of the second scroll 70, the torque repulsive force may be converted into the sealing force.

As described above, the rotational center C2 of the second scroll 70 has to be positioned to meet a condition of the angular displacement x, and in addition, when the first scroll 60 and the second scroll 70 are assembled, wraps 62 and 72 may be positioned at positions to be easily engaged with each other without interference therebetween. To this end, a rotational range restriction structure or restrictor may be further included in the co-rotating scroll compressor.

As illustrated FIGS. 11 and 12, the rotational range restrictor may include a rotation restrictor groove 122 formed in a portion of the housing accommodation hole 15 and a rotation restrictor protrusion 163 accommodated in the rotation restrictor groove 122. As the rotation restrictor protrusion 163 is installed on the bearing housing 16 to protrude further outward than an outer circumferential surface of the bearing housing 16 and is smaller than the rotation restrictor groove 122, the bearing housing 16 may rotate only within a range in which the rotation restrictor protrusion 163 may rotate in the rotation restrictor groove 122.

Figure 14:
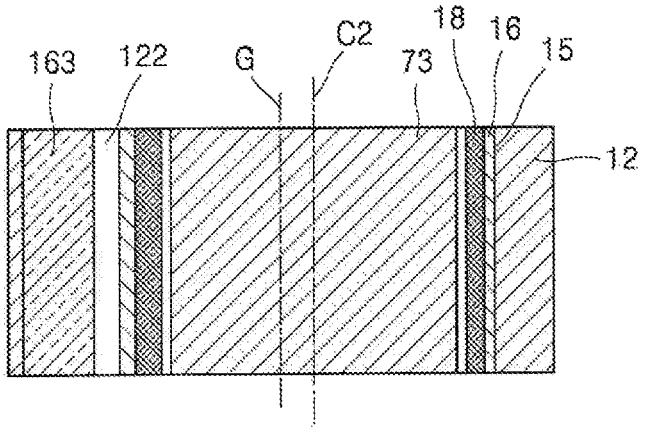
FIG. 14 is a side cross-sectional view illustrating a modified example of the rotary shaft support of FIG. 11.
Figure 15:
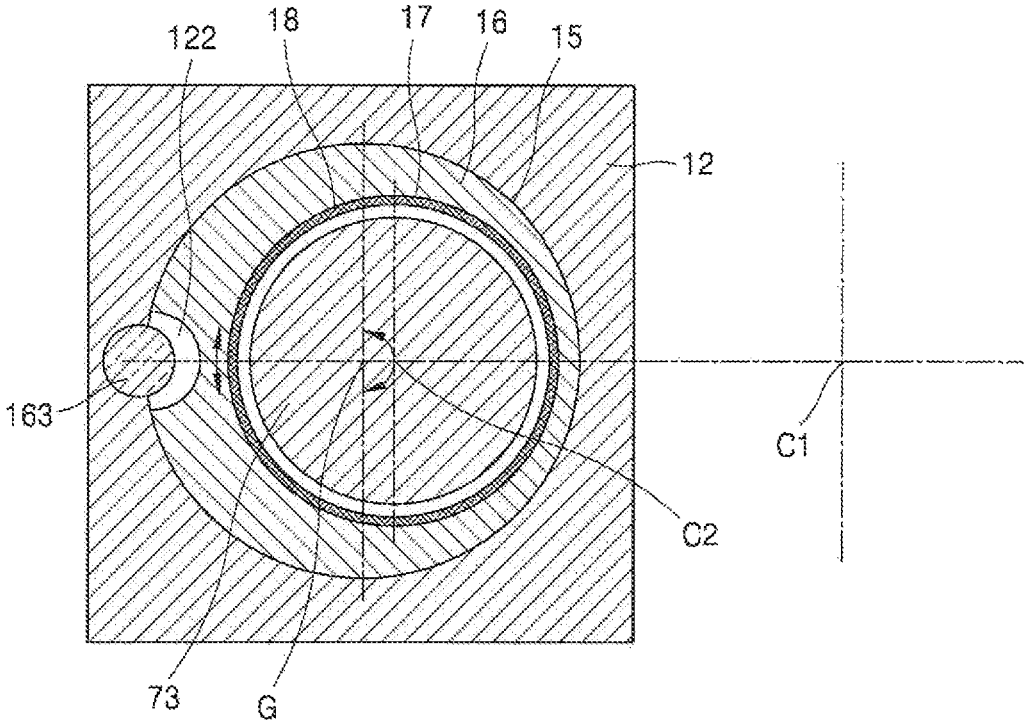
FIG. 15 is a top cross-sectional view of the rotary shaft support of FIG. 14.

Referring to FIGS. 14 and 15, a structure in which the rotation restrictor groove 122 is formed in a portion of the outer circumferential surface of the bearing housing 16 and the rotation restrictor protrusion 163 accommodated in the rotation restrictor groove 122 is installed at a circumference of the housing accommodation hole 15 may also be formed as a modified example of such a rotation range restrictor. As the rotation restrictor protrusion 163 is also smaller than the rotation restrictor groove 122, the bearing housing 16 may rotate only within a range in which the rotation restrictor protrusion 163 does not interfere with the rotation restrictor groove 122.

The rotation restrictor protrusion 163 may be separately manufactured and fixedly inserted into a groove formed in an outer circumferential surface of the bearing housing (see FIGS. 11 and 12) or in a circumference of the housing accommodation hole 15 (see FIGS. 14 and 15). When the rotational range of the bearing housing 16 is restricted as described above, a range in which the rotational center C2 of the rotary shaft of the second scroll 70 rotates about the rotational center G is also ultimately restricted. Accordingly, in such a structure, the second scroll 70 and the first scroll 60 may be easily assembled and the torque repulsive force generated at the second scroll 70 when the compressor operates may be converted into the sealing force Fseal.

According to embodiments, as a sealing force between wraps of two scrolls of a co-rotating scroll compressor is generated by a bearing displacement structure of a second scroll, leakage of compression pockets may be prevented, the two scroll wraps of the co-rotating scroll may be pressed against each other in a simple structure, and thus, manufacture and assembly thereof may be simple.

Embodiments disclosed herein are directed to a structure of a co-rotating scroll compressor in which two scroll wraps of co-rotating scrolls are pressed against each other in a simple structure, and manufacture and assembly thereof are simple.

According to embodiments disclose herein, a moving bearing configured to generated a sealing force of wraps may be installed in a co-rotating scroll compressor which may include a frame provided with a compression chamber; a first scroll and a second scroll including wraps disposed to face each other in the compression chamber, and rotary shafts which are eccentric each other. The first scroll and the second scroll rotary relative to each other in a same direction, compress a suctioned fluid in the compression chamber, and discharge the compressed fluid to an outside of the compression chamber; a fixed bearing installed in a bearing installation hole formed in the frame to support the rotary shaft of the first scroll; a moving bearing configured to support a rotary shaft of the second scroll; a bearing housing provided with a bearing accommodation hole configured to accommodate the moving bearing; and a housing accommodation hole formed in the frame and configured to moveably accommodate the bearing housing. In the second scroll rotatably supported by the moving bearing a real rotational center of the second scroll may be moveable in a direction parallel to a straight line from a rotational center of the first scroll to a theoretical rotational center of the second scroll, the real rotation center of the second scroll may be positioned to be offset a predetermined distance from the theoretical rotational center of the second scroll in a direction opposite an acting direction of a torque repulsive force applied to the second scroll, the moving bearing configured to support the rotary shaft of the second scroll may convert some of the torque repulsive force ($F\theta$) into a sealing force against a sealing disturbing force, and thus, the wrap of the second scroll may be pressed against the wrap of the first scroll by the sealing force.

A movement path of a center of the bearing housing accommodated in the housing accommodation hole may have a straight line shape, a center of the bearing installation hole may be positioned on a straight line including the movement path of the bearing housing, and thus a machining process of the housing accommodation hole may be simplified. The moving bearing may be positioned to be offset from a center of the bearing housing in a direction opposite the acting direction of the torque repulsive force, the bearing accommodation hole eccentric from the bearing housing may be machined at the bearing housing relatively easy to machine, and thus, a machining process may be simplified.

An offset distance may be set to meet an expression of $Fseal=F\theta\ \tan(\sin^{-1}(a/e))-Fr>0$, where e is a distance between the rotational center of the first scroll and the rotational center of the second scroll, and thus, the sealing force may prevent leakage from compression pockets.

The housing accommodation hole may have a hole in a track shape having a short axis and a long axis. The bearing housing may have a track shape having a short axis corresponding to the short axis of the housing accommodation hole and a long axis shorter than the long axis of the housing accommodation hole.

The bearing housing may be installed in the housing accommodation hole to be swingable, a rotational center of the second scroll may be positioned at a position eccentric from a swing center in the bearing housing, and the bearing housing may be swung by a torque repulsive force applied to the second scroll, some of the torque repulsive force may be converted into a sealing force against a sealing disturbing force, and thus, the wrap of the second scroll may be pressed against the wrap of the first scroll by the sealing force.

The second scroll may be positioned at a position swung by a predetermined angle with respect to a line from the swing center to a rotational center of the first scroll in a direction opposite to an acting direction of the torque repulsive force applied to the rotational center of the second scroll. The predetermined angle may fall within a range of $\tan^{-1}(e/g)<x<180°$"or"$360°-\tan^{-1}(e/g)<x\leq 360°$, where e is a distance between the rotational center of the first scroll and the rotational center of the second scroll, and g is a distance between the swing center and the rotational center of the second scroll, and thus, the sealing force may prevent leakage from the compression pockets.

A swing shaft having a substantially circular cross-section may extend downward from a lower end portion or end of the bearing housing, and a swing center groove into which the swing shaft may be rotatably inserted may be formed in a lower end surface of the housing accommodation hole. The co-rotating scroll compressor may further include a swing range restriction structure or restrictor configured to restrict a swing range of the bearing housing accommodated in the housing accommodation hole. The swing range may be restricted by interference between an outer circumferential surface of the bearing housing and an inner circumferential surface of the housing accommodation hole having an area greater than an area of the bearing housing and configured to accommodate the outer circumferential surface of the bearing housing such that the bearing housing is swingable.

The swing range restriction structure may include a swing restrictor protrusion formed in the frame, and a swing restrictor groove formed in the swing shaft, having an area greater than are area of the swing restrictor protrusion, and configured to accommodate the swing restrictor protrusion such that the swing restrictor protrusion is swingable. The swing range restriction structure may include a swing restrictor protrusion formed on the swing shaft, and a swing restrictor groove formed in the frame, having an area greater than an area of the swing restrictor protrusion, and configured to accommodate the swing restrictor protrusion such that the swing restrictor protrusion is swingable.

The bearing housing may be installed in the housing accommodation hole to be rotatable, a rotational center of the second scroll may be positioned at a position eccentric from a rotational center in the bearing housing, the bearing housing may be rotated by a torque repulsive force applied to the second scroll, some of the torque repulsive force may be converted into a sealing force against a sealing disturbing force, and thus, the wrap of the second scroll may be pressed against the wrap of the first scroll by the sealing force.

The second scroll may be positioned at a position rotated by a predetermined angle relative to a line from the rotational center of the bearing housing to a rotational center of the first scroll in a direction opposite an acting direction of the torque repulsive force applied to the rotational center of the second scroll, the predetermined angle may fail within a range of $\tan^{-1}(e/g)<x<180°$"or"$360°-\tan^{-1}(e/g)<x\leq 360°$, where e is a distance between the rotational center of the first scroll and the rotational center of the second scroll, and g is a distance between the rotational center of the bearing housing to the rotational center of the second scroll, and thus, the sealing force may prevent leakage from compression pockets.

The housing accommodation hole may have a circular cross-section, and the bearing housing may have a cross-section corresponding to a cross-section of the housing accommodation hole.

The co-rotating scroll compressor may further include a rotational range restriction structure or restrictor configured to restrict a rotational range of the bearing housing accommodated in the housing accommodation hole. The rotational range restriction structure may include a rotation restrictor groove formed at one of a portion of a circumference of the housing accommodation hole and an outer circumferential portion of the bearing housing, and a rotation restrictor protrusion accommodated in the rotation restrictor groove and formed at the other of the portion of the circumference of the housing accommodation hole and the outer circumferential portion of the bearing housing.

Specific effects in addition to the above described effect have been described while a specific description for realizing embodiments was described above. As described above, while embodiments have been described with reference to the accompanying drawings, the embodiments are not limited to those disclosed and drawings illustrated, and it should be clear to those skilled in the art that various modifications may be made within a technical sprit. In addition, although effects according to the structure have not been clearly described, predictable effects according to the corresponding structure should also have been naturally recognized.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A co-rotating scroll compressor, comprising:

a frame provided with a compression chamber the frame having a main frame and a sub-frame;

a first scroll and a second scroll including wraps disposed to face each other in the compression chamber and rotary shafts which are eccentric to each other, wherein the first scroll and the second scroll rotate relative to each other in a same direction, compress a fluid suctioned into the compression chamber, and discharge the compressed fluid outside of the compression chamber, the first scroll being installed in the main frame and the second scroll being installed in the sub-frame;

a fixed bearing installed in a bearing installation hole formed in the main frame to support the rotary shaft of the first scroll;

the installation of the second scroll in the sub-frame further including:

a moving bearing to support the rotary shaft of the second scroll;

a bearing housing provided with a bearing accommodation hole to accommodate the moving bearing; and a housing accommodation hole formed in the sub-frame to moveably accommodate the bearing housing, wherein in the second scroll rotatably supported by the moving bearing, a real rotational center of the second scroll is movable in a direction parallel to a straight line that extends from the rotational center of the first scroll to a theoretical rotational center of the second scroll, the theoretical rotational center of the installed second scroll being based, at least in part, on an amount of pre-determined variation associated with the installation of the second scroll in to the sub-frame which thereby locates the theoretical rotational center of the second scroll at a position different from a position of the real rotational center of the second scroll, the position of the real rotational center of the second scroll being axially offset a predetermined distance from the position of the theoretical rotational center of the second scroll in a direction opposite to an acting direction of a torque repulsive force applied to the second scroll when the co-rotating scroll compressor is in operation, and wherein the moving bearing that supports the rotary shaft of the second scroll converts some of the torque repulsive force into a seal force applied against a second sealing disturbing force so that the wrap of the second scroll is pressed against the wrap of the first scroll by the seal force.

2. The co-rotating scroll compressor of claim 1, wherein a movement path of a center of the bearing housing accommodated in the housing accommodation hole is along a straight line path, and the center of the bearing installation hole is positioned on a straight line that also includes the straight line movement path of the bearing housing.

3. The co-rotating scroll compressor of claim 1, wherein the moving bearing is offset from a center of the bearing housing in a direction opposite to the acting direction of the torque repulsive force.

4. The co-rotating scroll compressor of claim 2, wherein the moving bearing is offset from a center of the bearing housing in a direction opposite to the acting direction of the torque repulsive force.

5. The co-rotating scroll compressor of claim 1, wherein the housing accommodation hole is offset from the theoretical rotational center of the second scroll in a direction opposite to the acting direction of the torque repulsive force applied to the second scroll.

6. The co-rotating scroll compressor of claim 5, wherein the moving bearing is located at a center of the bearing housing.

7. The co-rotating scroll compressor of claim 1, wherein the seal force (Fseal) satisfies a mathematical expression of $Fseal=F\theta\ \tan(\sin^{-1}(a/e))-Fr>0$, where a is the offset distance, e is a distance between the rotational center of the first scroll and the rotational center of the second scroll, Fseal is the seal force between the wraps of the first scroll and the second scroll, Fr is the sealing disturbing force, and Fθ is the torque repulsive force.

8. The co-rotating scroll compressor of claim 1, wherein the housing accommodation hole is a hole having a short axis and a long axis, and the bearing housing has a track shape having a short axis corresponding to the short axis of the housing accommodation hole and a long axis shorter than the long axis of the housing accommodation hole.

9. A co-rotating scroll compressor, comprising:

a frame provided with a compression chamber;

a first scroll and a second scroll including wraps disposed to face each other in the compression chamber and rotary shafts which are eccentric to each other, wherein the first scroll and the second scroll rotate relative to each other in a same direction, compress a fluid suctioned into the compression chamber, and discharge the compressed fluid outside of the compression chamber;

a fixed bearing installed in a bearing installation hole formed in the frame to support the rotary shaft of the first scroll;

a moving bearing configured to support the rotary shaft of the second scroll;

a bearing housing provided with a bearing accommodation hole configured to accommodate the moving bearing; and a housing accommodation hole formed in the frame and configured to moveably accommodate the bearing housing, wherein the bearing housing is installed in the housing accommodation hole, wherein a rotational center of the second scroll is positioned at a position eccentric from a swing center in the bearing housing, and wherein the bearing housing is swung by a torque repulsive force applied to the second scroll, some of the torque a seal force against a sealing distribution force, and the wrap of the second scroll is pressed against the wrap of the first scroll by the seal force.

10. The co-rotating scroll compressor of claim 9, wherein the second scroll is positioned at a position swung by a predetermined angle with respect to a line from the swing center to a rotational center of the first scroll in a direction opposite to an acting direction of the torque repulsive force applied to the rotational center of the second scroll, and the predetermined angle falls within a range of $\tan^{-1}(e/g) < x < 180°$ or $360° - \tan^{-1}(e/g) < x \leq 360°$, where e is a distance between the rotational center of the first scroll and the rotational center of the second scroll, and g is a distance between the swing center and the rotational center of the second scroll.

11. The co-rotating scroll compressor of claim 9, wherein a swing shaft having a substantially circular cross-section extends downward from a lower end of the bearing housing, and a swing center groove into which the swing shaft is rotatably inserted is formed in a lower end surface of the housing accommodation hole.

12. The co-rotating scroll compressor of claim 9, further comprising a swing range restrictor configured to restrict a swing range of the bearing housing accommodated in the housing accommodation hole.

13. The co-rotating scroll compressor of claim 12, wherein the swing range is restricted by interference between an outer circumferential surface of the bearing housing and an inner circumferential surface of the housing accommodation hole having an area greater than an area of the bearing housing and configured to accommodate the outer circumferential surface of the bearing housing such that the bearing housing is swingable.

14. The co-rotating scroll compressor of claim 11, further comprising a swing range restrictor configured to restrict a swing range of the bearing housing accommodated in the housing accommodation hole, wherein the swing range restrictor includes:

a swing restrictor protrusion formed in the frame; and a swing restrictor groove formed in the swing shaft, having an area greater than an area of the swing restrictor protrusion, and configured to accommodate the swing restrictor protrusion.

15. The co-rotating scroll compressor of claim 11, further comprising a swing range restrictor configured to restrict a swing range of the bearing housing accommodated in the housing accommodation hole, wherein the swing range restrictor includes:

a swing restrictor protrusion formed on the swing shaft; and a swing restrictor groove formed in the frame, having an area greater than an area of the swing restrictor protrusion, and configured to accommodate the swing restrictor protrusion such that the swing restrictor protrusion is swingable.

16. A co-rotating scroll compressor, comprising:

a frame provided with a compression chamber;

a first scroll and a second scroll including wraps disposed to face each other in the compression chamber and rotary shafts which are eccentric to each other, wherein the first scroll and the second scroll rotate relative to each other in a same direction, compress a fluid suctioned into the compression chamber, and discharge the compressed fluid to an outside of the compression chamber;

a fixed bearing installed in a bearing installation hole formed in the frame to support the rotary shaft of the first scroll;

a moving bearing configured to support the rotary shaft of the second scroll;

a bearing housing provided with a bearing accommodation hole configured to accommodate the moving bearing; and a housing accommodation hole formed in the frame and configured to movably accommodate the bearing housing, wherein the bearing housing is installed in the housing accommodation hole, a rotational center of the second scroll is positioned at a position eccentric from a rotational center in the bearing housing, and the bearing housing is rotated by a torque repulsive force applied to the second scroll, some of the torque repulsive a seal force against a sealing distribution force, and the wrap of the second scroll is pressed against the wrap of the first scroll by the seal force.

17. The co-rotating scroll compressor of claim 16, wherein the second scroll is positioned at a position rotated by a predetermined angle relative to a line from the rotational center of the bearing housing to a rotational center of the first scroll in a direction opposite to an acting direction of the torque repulsive force applied to the rotational center of the second scroll, and the predetermined angle falls within a range of $\tan^{-1}(e/g) < x < 180°$ or $360° - \tan^{-1}(e/g) < x \leq 360°$, where e is a distance between the rotational center of the first scroll and the rotational center of the second scroll, and g is a distance between the rotational center of the bearing housing and the rotational center of the second scroll.

18. The co-rotating scroll compressor of claim 16, wherein the housing accommodation hole has a circular cross-section; and wherein the bearing housing has a cross-section corresponding to a cross-section of the housing accommodation hole.

19. The co-rotating scroll compressor of claim 16, further comprising a rotational range restrictor configured to restrict a rotational range of the bearing housing accommodated in the housing accommodation hole.

20. The co-rotating scroll compressor of claim 19, wherein the rotational range restrictor includes:

a rotation restrictor groove formed at a first location of one portion of a circumference of the housing accommodation hole and an outer circumferential portion of the bearing housing; and a rotation restrictor protrusion accommodated in the rotation restrictor groove and formed at a second location of the one portion of the circumference of the housing accommodation hole and the outer circumferential portion of the bearing housing.

* * * * *